United States Patent [19]

Pucci

[11] Patent Number: 4,974,887

[45] Date of Patent: Dec. 4, 1990

[54] LOCKING DEVICE FOR SLIDING MEMBERS

[76] Inventor: Dominic Pucci, 2121 NE. 31st. Ave., Lighthouse Point, Fla. 33064

[21] Appl. No.: 129,838

[22] Filed: Dec. 8, 1987

[51] Int. Cl.[5] ..... E05C 3/04

[52] U.S. Cl. ..... 292/228; 292/DIG. 47

[58] Field of Search ..... 292/121, 128, 219, 228, 292/262, 338, 339, DIG. 47, DIG. 33

[56] References Cited

U.S. PATENT DOCUMENTS

| | | | |
|---|---|---|---|
| 536,161 | 3/1895 | Steeck | 292/228 |
| 724,081 | 3/1903 | Brown | 292/228 |
| 1,711,831 | 5/1929 | Clavin | 292/228 |
| 1,762,070 | 6/1930 | Moodt | 292/228 |
| 1,773,751 | 8/1930 | Reidhaar | 292/228 |
| 2,768,850 | 10/1956 | Minnis, Jr. | 292/338 X |
| 4,070,049 | 1/1978 | Brewer | 292/338 X |
| 4,721,332 | 1/1988 | Sturman | 292/128 |

*Primary Examiner*—Richard E. Moore

*Attorney, Agent, or Firm*—Malin, Haley, McHale, DiMaggio & Crosby

[57] ABSTRACT

A locking device to prevent relative sliding movement between two relatively movable members, for example, sliding window and sliding door members, one of said relatively movable members having at least one opening which can be placed in a predetermined position thereon. The other of said two relatively movable members having said locking device mounted thereon, the locking device including a mounting member having a base portion and a pair of oppositely facing portions projecting upwardly therefrom, said base portion provided with a pair of spaced mounting apertures and a spring retaining detent, a spring biased lever member pivotally mounted within said oppositely facing portions, an inwardly projecting locking pin provided on one end of said lever member which is biased into locking engagement with said at least one opening.

6 Claims, 2 Drawing Sheets

LOCKING DEVICE FOR SLIDING MEMBERS

BACKGROUND OF THE INVENTION

The present invention relates generally to locking devices and more particularly to locking devices for preventing relative movement between relatively movable members such as sliding window and sliding door assemblies.

Many attempts have been made at providing improved security to home owners. Sliding windows and sliding doors are generally provided with some type of latch or locking mechanism to prevent unauthorized entry into one's home. However, it has been found that the locking devices provided by manufacturers for such window and door assemblies does not provide the degree of security desired by most homeowners. The prior art locking devices usually become inoperative after a relatively short period of time through use and/or abuse, rendering the door or window unlockable. Furthermore, even if the provided locking mechanism were not inoperable, they are readily forced open by means of a screwdriver or some other tool. Thus many people have resorted to the backup or secondary locking mechanism to provide additional security and peace of mind.

SUMMARY OF THE INVENTION

In view of the above described problems, various types of mechanisms such as locking bars have come into popular use. However, locking bars are considered by some people to be rather unsightly. Some locking bars are provided with a spring and/or latch mechanism to load and secure the bar in its desired position. After a period of use, the spring and/or latch mechanism will eventually fail. Another disadvantage of locking bars is the fact that bending is usually required of the person setting the bar into its locked position. Since it is primarily elderly persons who feel the need for the additional security, it is also they who suffer from various age related ailments making bending a painful experience. Also, the fact that a locking bar is usually mounted at floor level in the track of the movable member, it is relatively inaccessible and out of reach when in the standing position, which frequently results in it being forgotten and therefore not set into the locking position.

The present locking means overcomes these and other shortcomings of these known devices and provide significant advantages thereover. Briefly, the subject locking means in its preferred form includes a relatively small device which would be available in matching colors for most windows and doors on today's market to permit it to readily blend in with the frame structure. It is simple to install with only a screwdriver and drill required to complete the job. It comprises two main components plus a spring and a pivot pin which renders it easy to assemble during the installation operation. This last mentioned advantage makes for easy installation during the manufacture of the window or door as well.

The subject locking device has been designed with the average homeowner in mind. Thus permitting the retro-fitting of the sliding windows and doors found in most modern homes. The number of components has been kept to a minimum and the design is such that it is impossible to be installed incorrectly. In order to improve the overall appearance of the locking device, provision has been made for mounting the main body first and then the lever member is received between a pair of projecting walls of said main body member thereby concealing the fastening means whether it be sheet metal screws or rivets.

The present locking device can be operated almost indefinitely without failure since there is only one moving part which produces the locking action. When the window or door is locked with the subject locking device, the locking pin will be subjected to a shearing action as the door or window is attempted to be opened. It would be impossible to shear the pin in attempting to force open the door or window. The window or door frame would undergo failure before the pin would shear. Since there is no camming action undertaken in the locking operation there is no possibility of reverse camming by use of a screwdriver to force the window or door open.

OBJECTS OF THE INVENTION

An object of the invention is to provide a locking device which is readily adaptable to conventional sliding windows or doors.

A further object of the invention is to provide a locking device which has only one moving part.

Yet another object of the invention is the provision of a locking device which has a pleasing appearance without any mounting screws visible when mounted.

A still further object of the invention is to provide a locking device which can be set into locking position with a fingers touch.

Yet another object of the invention is to provide a locking device which is conveniently located on the window or door frame which permits locking simultaneously with the closing of the window or door.

Another object of the invention is the provision of a locking device which is inaccessible from the outside thus making a forced entry impossible without breaking the window or door.

A further object of the invention is the provision of a locking device which can be utilized to secure two relatively movable members other than windows or doors in a desired position.

Yet another object of the invention is the provision of a locking device which can be readily installed by the manufacturer of sliding doors and windows.

These and other objects of the invention will become more apparent from the following description and appended claims, reference being made to the accompanying drawings which form a part of the specification wherein like reference characters designate corresponding parts in the several views.

DETAILED DESCRIPTION OF THE PREFERRED EMBODIMENT

Figure 1:
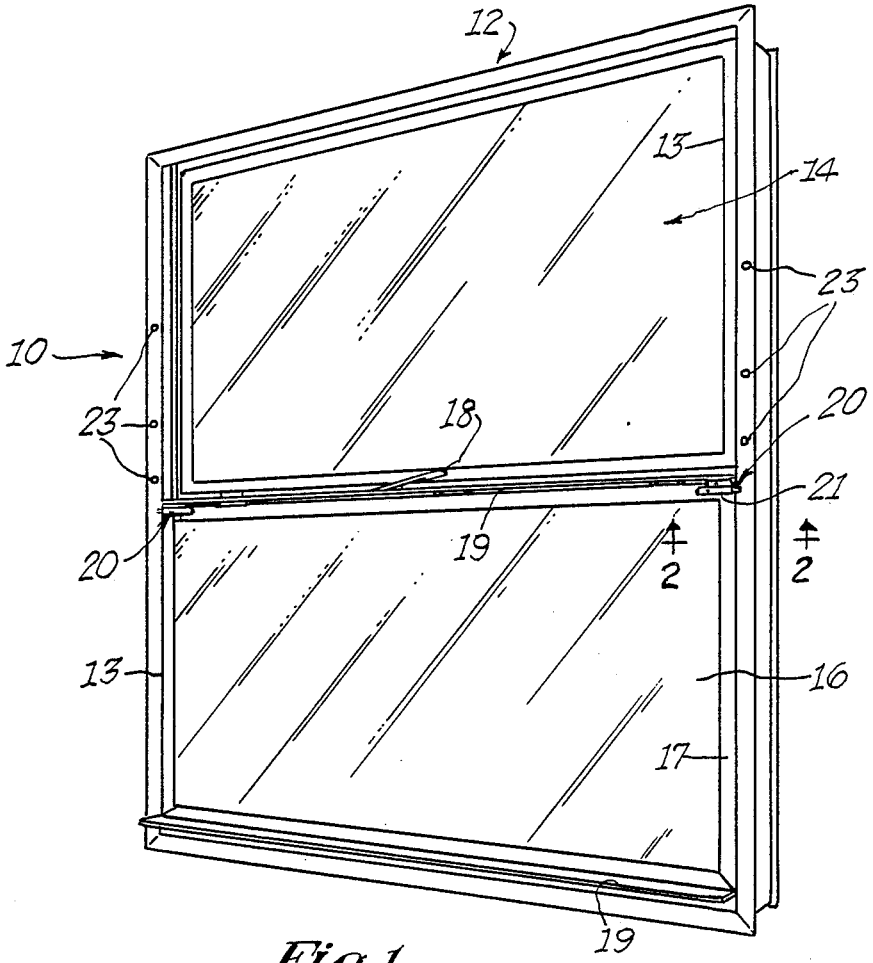
FIG. 1 is an illustration of a conventional vertical sliding window provided with a pair of the novel locking devices.

Referring now to FIG. 1, there is shown an inside view of a conventional aluminum sliding window 10 which comprises an aluminum main frame 12 with a stationary upper window 14 fixed mounted therein. Lower window 16 is also mounted in main frame 12. However, lower window 16 can be raised or lowered once sash latch 18 is released. Sash latch 18 is readily accessible from the outside by a screwdriver or other appropriate tool being inserted between the stationary upper window 14 and lower window 16. Thus sash latch 18 is readily rendered useless.

As a means of improving the security of sliding type windows there is shown in FIG. 1 a pair of locking devices 20 which are secured to window frame 17 of lower window 16 at its opposite upper end. As illustrated, locking device 20 is in its locked position by means of locking pin 22 (not visible in FIG. 1) which projects downward from the end portion of lever member 21 and has seated itself into locking apertures 23 under lever member 21. Additional apertures 23 are provided at spaced intervals along vertical frame member 13. A plurality of spaced apertures 23 are provided in each vertical frame member 13 to permit opening of lower window 16 at different levels, if so desired. As also can be seen from FIG. 1, locking devices 20 are positioned immediately under inwardly projecting upper flange 19. By so locating locking devices 20, they are hidden from the view of someone positioned on the outside of sliding window 10 thereby providing an additional degree of security.

It is also to be noted that the location of locking device 20 makes it very convenient for the locking device 20 to be set into locking position simultaneously with the closing of lower window 16. To accomplish this, one merely grasps opposite ends of upper flange 19 with both hands and when lower window 16 is about to reach the end of its downward travel, merely finger depressing inner ends of lever members 21 will raise the end of locking pins 22. When lower window 16 has reached its lowermost position, releasing of lever members 21 permit locking pins 22 to enter locking apertures 23 and thus securely lock lower window 16. As an added measure of security, sash latch 18 may also be placed in its locking position at this time. Locking device 20 may alternatively be located under lower flange 19 if so desired. However, the upper location is preferred since it is approximately at eye level which serves as a visual reminder to set locking devices 20 when closing lower window 16. Further it is considered to be a matter of user desire as to whether one or two locking devices are employed per window. Although a single locking device 20 will work effectively, a second locking device 20 will add balance to the appearance of the window and also provide an added measure of security.

Figure 2:
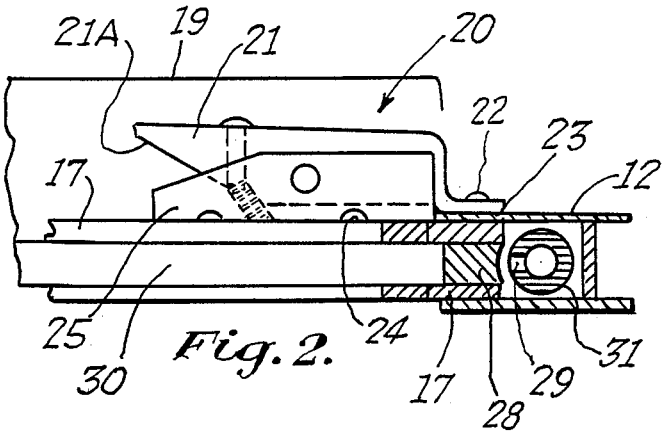
FIG. 2 is a cross sectional view of FIG. 1 taken along the lines 2—2 looking in the direction of the arrows.

Referring now to FIG. 2 which is a sectional view taken along the lines 2—2 of FIG. 1 wherein locking device 20 is shown as being attached to lower window frame 17 by means of a pair of pop rivets or screws 24. Lever member 21 is shown in its biased closed position with locking pin 22 received in locking aperture 23. As pointed out earlier, locking pin 22 would be exposed to shear force if lower window 16 were raised up with locking pin in its locked position. Also, member 21 is shown as having a raked downwardly declined edge 21A. The purpose of raked edge 21A is to permit lever member 21 to pivot to the position shown in FIG. 3. If edge 21A were not present there would be interference between lever member 21 and main body member 25 when lever member 21 would be pivoted. Likewise main body member 25 has a raked edge 25A so as not to interfere when lever member 21 is being depressed. FIG. 2 also illustrates the mounting of glass pane 30 within window frame 17 which is slidably mounted in main frame 12. Glass pane 30 is provided at opposite sides with a friction member 28 preferably made of nylon or teflon having a recessed portion 29 which substantially conforms to vertical member 31.

Figure 3:
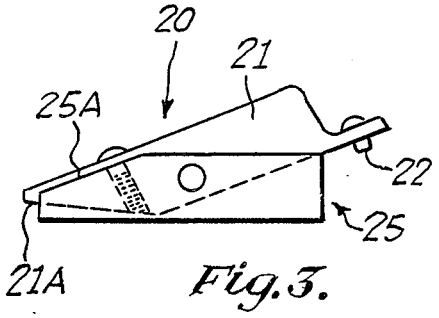
FIG. 3 is a side view of the locking device with the locking pin in its raised position.

FIG. 3 is a side elevation of locking device 20 with lever member 21 depressed and locking pin 22 in its raised position.

Figure 5:
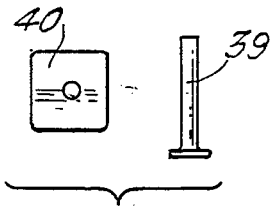
FIG. 5 is an illustration of the pivot pin and retaining clip.
Figure 4:
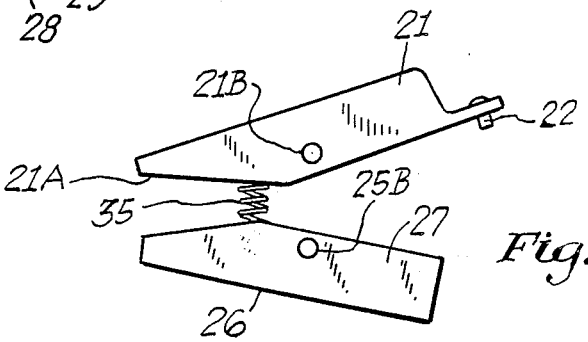
FIG. 4 is a disassembled view of the locking device.

Referring now to FIG. 4, there is shown the two main components of the locking device 20 prior to their being assembled into an operative device. As indicated earlier, main body 25 is provided with a base portion 26 and a pair of oppositely facing upwardly projecting walls 27. The upper end of spring 35 is positioned within lever member 21 and prevented from moving laterally by means of tab 36 in lever 21. The lower end of spring 35 is positioned within main body member 25 and prevented from moving laterally by means of tab 37. FIG. 4 also illustrates the relative position of members 21 and 25 before spring 35 is fully compressed to align apertures 21B and 25B to permit pivot pin 39 to be inserted therethrough and then secured by the retaining clip 40 of FIG. 5. The components are so illustrated since that is how the individual locking device 20 will be packaged. The components will be unassembled since main body member 25 has to be mounted to the window frame 17 before the components can be assembled. As mentioned earlier, the reason for this is to permit mounting screws to be inserted into apertures 25C in base portion 26 of main body member 25 to securely mount it to frame 17. After main body member 25 is fastened to frame member 17, spring 35 is placed in position, then lever member 21 is placed inside projecting walls 27 and apertures 25B and 21B are aligned permitting pivot pin 39 to be inserted therein and retaining clip 40 placed over its end. In the unlikely event that spring 35 would at some time fail and require replacement, one merely needs to remove retaining clip 40, pull out pivot pin 39 and insert a new spring 35 beneath lever member 21, reinsert pivot pin 39 and replace retaining clip 40. A conventional bolt and nut could be used in lieu of the aforementioned pin 39 and clip 40.

Figure 6:
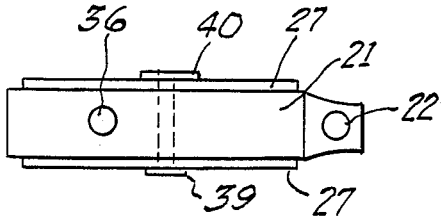
FIG. 6 is a top view of the locking device.
Figure 7:
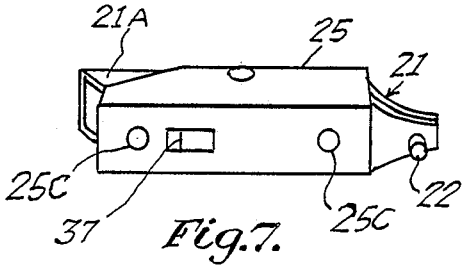
FIG. 7 is a perspective angle view of the locking device looking at the underside.

FIG. 6 is a plan view of locking device 20 illustrated in its assembled position. Pivot pin 39 and retaining clip 40 as well as tab 36 and locking pin 22 are also illustrated. FIG. 7 is a perspective view of the locking device slightly turned to illustrate the underside thereof. Tab 37 is struck upwardly into main body member 25.

Figure 8:
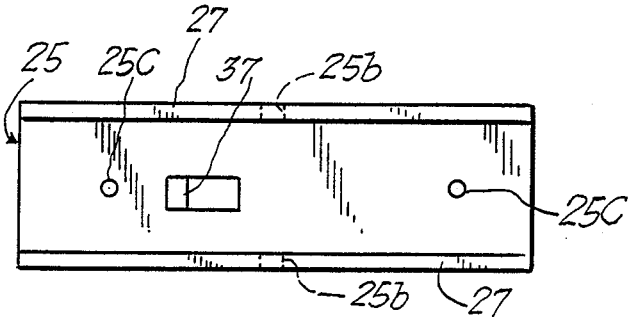
FIG. 8 is a plan view of the main body member.
Figure 9:
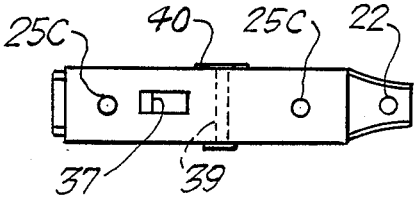
FIG. 9 is a bottom view of the locking device.

FIG. 8 is an enlarged plan view of main body member 25 illustrating opposite walls 27, mounting apertures 25C, pivot 25B and spring retaining tab 37. FIG. 9 is a bottom view similar to that of FIG. 7.

Figure 10:
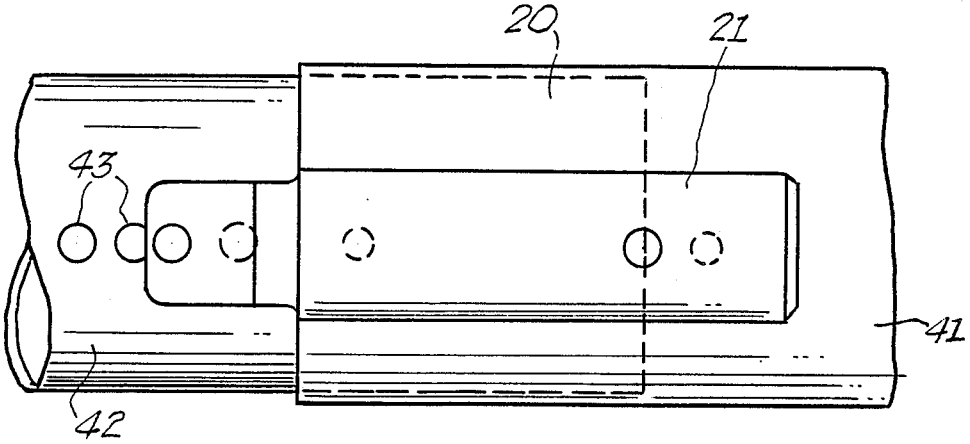
FIG. 10 is an illustration of the locking device used to maintain the relative position of a telescopic inner member.

FIG. 10 is an illustration of an alternative use of the novel locking device 20. Shown is a first or outer tubular member 41 which receives a second or inner tubular member 42. Locking device 20 is fixedly mounted to first tubular member 41. Second tubular member 42 is provided with a plurality of locking apertures 43. When second tubular member 42 is at its desired position, lever member 21 is released permitting spring 35 to bias lever member 21 to its locking position whereby locking pin 22 enters an aperture 43 to lock outer tubular member 41 and inner tubular member 42 in their desired relative position. Thus it can be seen that the subject invention has utility in environments other than that specifically set forth above.

While the invention has been described in its preferred embodiments, it is to be understood that the words which have been used are words of description rather than limitation and that changes may be made within the purview of the appended claims without departing from the true scope and spirit of the invention in its broader aspects.

Having thus described my invention, I claim:

1. In a window frame assembly including a window frame formed by a pair of generally vertical members with an inner face and a pair of interconnected generally horizontal members, a stationary window means mounted in said window frame with an inner face, a movable window means with an inner and outer face slidably mounted to move over said inner face of said stationary window means of said window frame into an opened position, said movable window means having an upper face and a locking system comprising a locking means mounted on said inner face of said movable window means and engageable with an aperture means adjacent said inner face of one of said vertical members of said window frame or vice versa; said locking means including a main body member connected to said inner face of said movable window means and a pivotable lever member pivotally connected to said body member, locking pin means integral with said pivotable lever member, and biasing means for urging said pivotable lever member and said locking pin means into locking engagement within said aperture means for preventing relative movement between said movable window means and said window frame; said locking means or said apertures of said locking system positioned on said inner face of said movable window means adjacent but spaced from said upper face of said movable window means, said locking pin means and said aperture means for positioning said movable window means partially opened in a locked position to allow air to enter a room and to prevent easy unlocking of said locking means by an intruder through said movable window means when partially opened at the bottom and/or through a space between said outer face of said movable window means and said inner face of said stationary window means where a window latch is normally positioned.

2. In a window frame assembly as set forth in claim 1 wherein said main body member comprises a base portion and a pair of spaced upwardly projecting walls, said pivotable lever member having a first end portion and a second end portion; said locking pin means located at said first end portion of said pivotable lever member and said second end portion having downwardly projecting walls; pivot means extending through said pair of upwardly projecting walls and said pair of downwardly projecting walls; said main body member and said pivotable lever member provided with retaining means for said biasing means; said biasing means positioned between said upwardly and downwardly projecting walls and maintained therebetween by said retaining means whereby said pivotable lever member is biased into locking engagement with said aperture means when said locking pin means is aligned with said last mentioned means.

3. In a window frame assembly as set forth in claim 2 wherein said one of said movable window means and said window frame is said movable window means.

4. In a window frame assembly as set forth in claim 2 wherein said aperture means comprises a plurality of spaced apertures on said window frame.

5. In a window frame assembly as set forth in claim 3 wherein said locking means is positioned on said movable window means generally near human eye level to serve as a visual reminder to set said locking means when said movable window means is moved to said closed position.

6. A locking system comprising a window frame, a movable window means, a fixed window means, and a lock means connectable to an adjacent portion of said window frame or an adjacent portion of said movable window means, said movable window means for sliding movement back and forth in front of said fixed window in a room, said movable window means and said fixed window means providing a space between said movable window means and said fixed window means allowing sliding movement therebetween, said movable window means includes an inside face and an outside face, said movable window means includes a top face portion adjacent the middle of said window frame when said movable window means is in a closed position, said lock means connected to said inside face of said movable window means or said inside face of said window frame with lock aperture in said inside face of said window frame or in said inside face of said movable window respectively, said lock means for allowing said movable window means to be placed in a partially opened locked position to provide a window opening with said latch means positioned far and readily inaccessible from said space between said movable window and said fixed window and positioned far and readily inaccessible from the space between said movable window means and said fixed window, said lock means including a main body connected to one of said inside faces, a pivotable lever member pivotally connected to said body member, a locking pin means integral with said pivotable lever member, and biasing means for urging said pivotable lever member and said locking pin means into locking engagement with said apertures for preventing relative movement between said movable window means and said window frame, whereby said locking system prevents easy unlatching of said lock means by an intruder.

* * * * *